US008784037B2

(12) United States Patent
Durocher et al.

(10) Patent No.: US 8,784,037 B2
(45) Date of Patent: Jul. 22, 2014

(54) TURBINE SHROUD SEGMENT WITH INTEGRATED IMPINGEMENT PLATE

(75) Inventors: Eric Durocher, Vercheres (CA); Guy Lefebvre, Saint-Bruno (CA)

(73) Assignee: Pratt & Whitney Canada Corp., Longueuil, QC (CA)

( * ) Notice: Subject to any disclaimer, the term of this patent is extended or adjusted under 35 U.S.C. 154(b) by 505 days.

(21) Appl. No.: 13/221,997

(22) Filed: Aug. 31, 2011

(65) Prior Publication Data

US 2013/0051979 A1 Feb. 28, 2013

(51) Int. Cl.
*F04D 29/58* (2006.01)

(52) U.S. Cl.
USPC ..... 415/116; 415/173.1; 415/176; 29/527.1; 164/80; 164/111; 164/112

(58) Field of Classification Search
CPC ..... F01D 11/02; F01D 11/12; F01D 11/005; F01D 25/08; F01D 25/12; F01D 25/14; F05D 2230/22; F05D 2230/23; F05D 2230/211; F05D 2240/11; F05D 2260/201; F05D 2260/20; B22D 17/00; B22D 19/00; B22D 19/04; B22D 23/06; F16J 15/328
USPC ..... 415/115, 116, 173.1, 175, 176, 177, 415/178; 164/80, 98, 111, 112, 113; 29/889.2, 527.1
See application file for complete search history.

(56) References Cited

U.S. PATENT DOCUMENTS 3,831,258 A 8/1974 Elbert et al.
4,137,619 A 2/1979 Beltran et al.
4,383,854 A 5/1983 Dembowski et al.
4,604,780 A 8/1986 Metcalfe
4,871,621 A 10/1989 Bagley et al.
5,010,050 A 4/1991 Wullenweber et al.
5,130,084 A 7/1992 Matheny et al.
5,553,999 A 9/1996 Proctor et al.
5,574,957 A 11/1996 Barnard et al.
5,772,748 A 6/1998 Hubbard
5,933,699 A 8/1999 Ritter et al.
5,950,063 A 9/1999 Hens et al.
6,102,656 A 8/2000 Nissley et al.
6,217,282 B1 4/2001 Stanka
6,350,404 B1 2/2002 Li et al.
6,679,680 B2 1/2004 Um et al.
6,709,771 B2 3/2004 Allister
6,857,848 B2 2/2005 Fokine et al.
6,874,562 B2 4/2005 Knott et al.
6,910,854 B2 6/2005 Joslin
7,029,228 B2 4/2006 Chan et al.
7,052,241 B2 5/2006 Decker
7,114,920 B2 10/2006 Synnott
7,128,522 B2 10/2006 Jutras
7,175,387 B2 2/2007 Kreis et al.
7,217,081 B2 5/2007 Scheurlen et al.
7,234,920 B2 6/2007 Imbourg et al.
7,407,622 B2 8/2008 Voice et al.
7,687,021 B2 * 3/2010 Imbourg et al. ..... 419/8

(Continued)

*Primary Examiner* — Edward Look
*Assistant Examiner* — William Grigos
(74) *Attorney, Agent, or Firm* — Norton Rose Fulbright Canada LLP

(57) ABSTRACT

A turbine shroud segment is metal injection molded (MIM) about an insert having a cooling air cavity covered by an impingement plate. The insert is held in position in an injection mold and then the MIM material is injected in the mold to form the body of the shroud segment about the insert.

17 Claims, 5 Drawing Sheets

(56) References Cited

U.S. PATENT DOCUMENTS

| | | | |
|---|---|---|---|
| 7,857,581 | B2 | 12/2010 | Mons et al. |
| 7,875,340 | B2 | 1/2011 | Cho et al. |
| 2005/0214156 | A1 | 9/2005 | Troitski et al. |
| 2010/0139288 | A1* | 6/2010 | Rago ..... 60/785 |
| 2011/0033331 | A1 | 2/2011 | Tuppen et al. |
| 2012/0186768 | A1 | 7/2012 | Sun et al. |

* cited by examiner

TURBINE SHROUD SEGMENT WITH INTEGRATED IMPINGEMENT PLATE

TECHNICAL FIELD

The application relates generally to the field of gas turbine engines, and more particularly, to turbine shroud segments.

BACKGROUND OF THE ART

Turbine shroud segments typically use complex design that require multiple manufacturing operations, including casting, welding as well as EDM techniques to form various features, such as feather seal slots, cooling air cavities, impingement baffles and air channels in the body of a shroud segment. The machining operations required to complete the part makes manufacturing of turbine shroud lengthy and expensive.

Therefore, opportunities for cost-reduction exist.

SUMMARY

In one aspect, there is provided a method of manufacturing a shroud segment for a gas turbine engine, the method comprising: providing an insert defining a cooling air cavity covered by an impingement plate having a plurality of holes defined therethrough; holding the insert in position in an injection mold; and metal injection molding (MIM) a shroud segment body about the insert to form a composite component, including injecting a metal powder mixture into the injection mold to partially imbed the insert into the shroud segment body and subjecting the composite component to debinding and sintering operations.

In a second aspect, there is provided a method of creating a cooling air cavity in a shroud segment of a gas turbine engine, the method comprising: metal injection molding (MIM) a shroud segment body about a hollow insert having a cavity covered by an impingement plate, the impingement plate being provided at a radially outwardly facing surface of the MIM shroud segment body and having a plurality of holes defined therethrough for admitting air into the cavity of the hollow insert.

In a third aspect, there is provided a shroud segment of a gas turbine engine comprising a metal injection molded (MIM) shroud body, an insert at least partly imbedded on a radially outer side of the MIM shroud body, the insert comprising first and second members defining therebetween a cooling air cavity, said first member having a plurality of impingement holes defined therethrough for directing cooling air into said cooling air cavity.

DESCRIPTION OF THE DRAWINGS

Reference is now made to the accompanying figures, in which.

DETAILED DESCRIPTION

Figure 1:
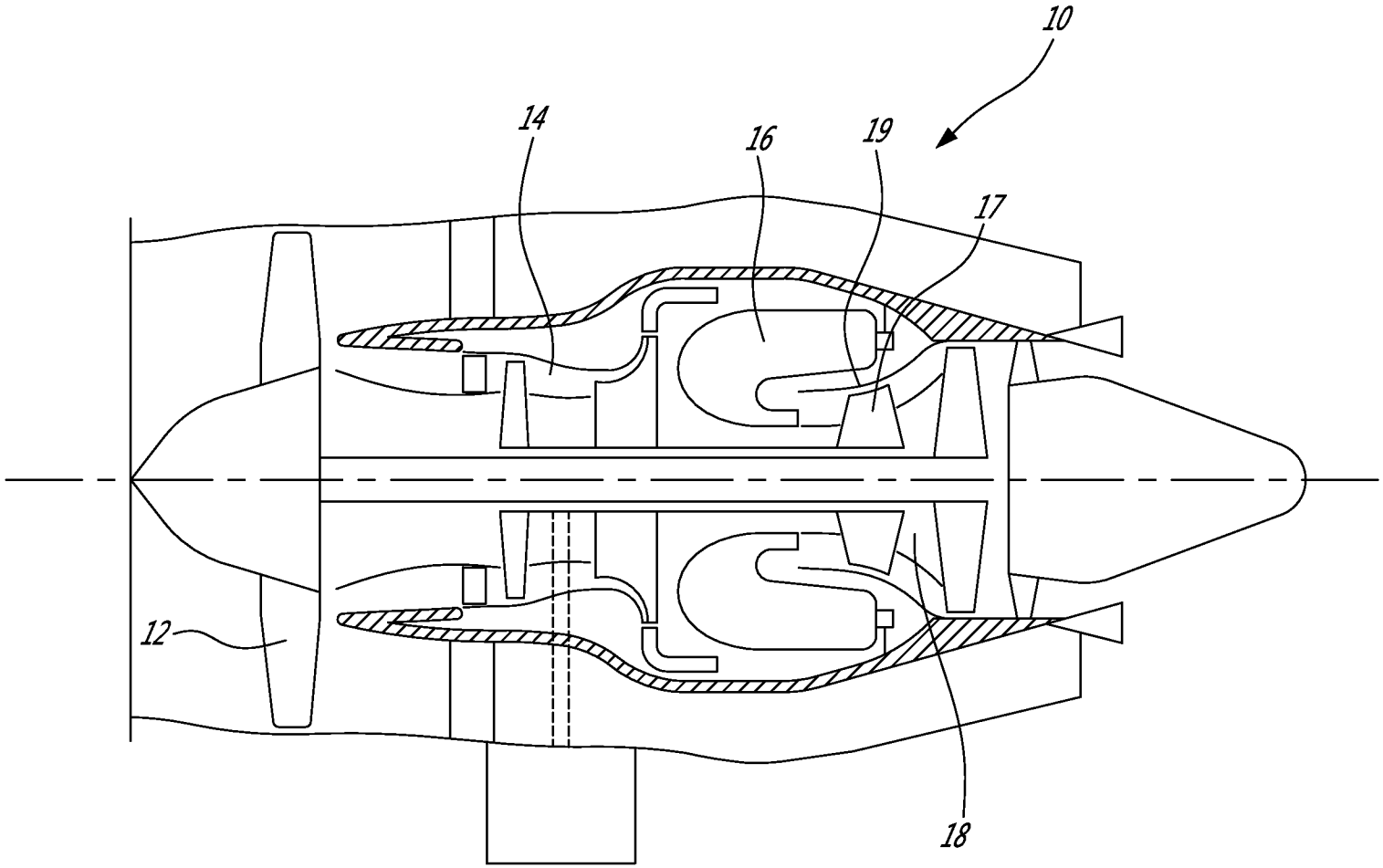
FIG. 1 is a schematic cross-section view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
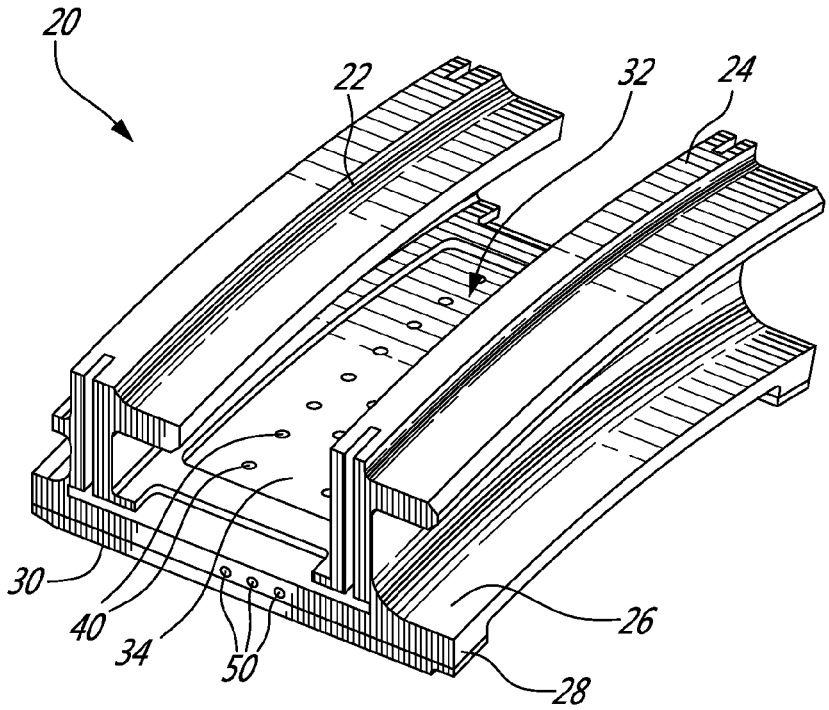
FIG. 2 is an isometric view of a turbine shroud segment having an insert including an integrated impingement plate in accordance with one aspect of the present application.
Figure 3:
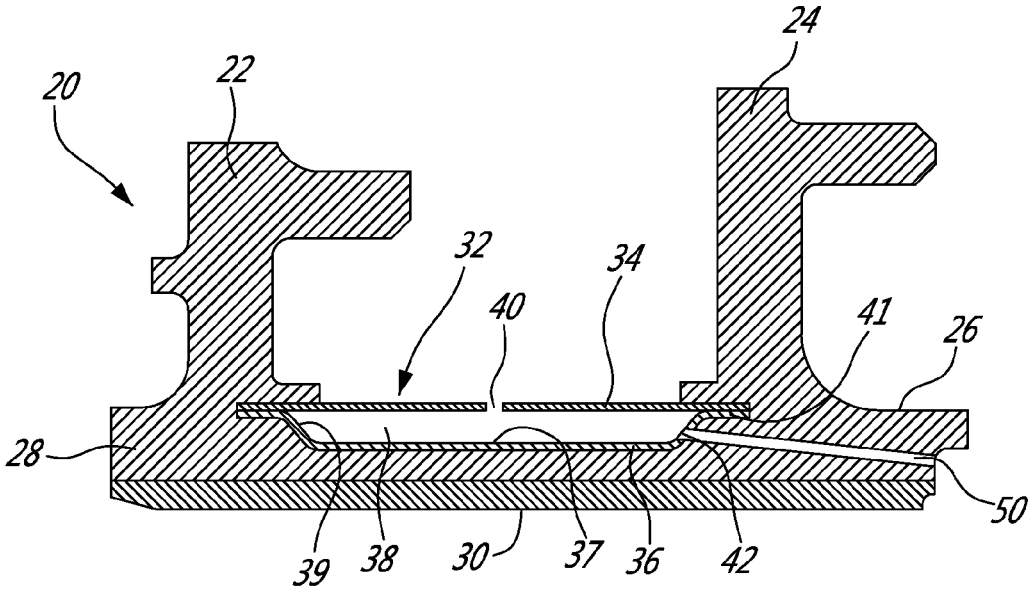
FIG. 3 is a cross-section of the turbine shroud segment shown in FIG. 2 and illustrating the insert embedded in the body of the shroud segment.

The turbine section 18 generally comprises one or more stages of rotor blades 17 extending radially outwardly from respective rotor disks, with the blade tips being disposed closely adjacent to an annular turbine shroud 19 supported from the engine casing. The turbine shroud 19 is typically circumferentially segmented. FIGS. 2 and 3 illustrate an example of one such turbine shroud segments 20. The shroud segment 20 comprises axially spaced-apart forward and aft hooks 22 and 24 extending radially outwardly from a cold radially outer surface 26 of an arcuate platform 28. The platform 28 has an opposite radially inner hot gas flow surface 30 adapted to be disposed adjacent to the tip of the turbine blades.

As can be appreciated from FIGS. 2 and 3, an insert 32 is imbedded into the radially outer surface 26 of the platform 28 between the forward and aft hooks 22 and 24. As will be seen hereinafter, the insert 32 may be integrated into the shroud segment 20 by metal injection molding (MIM) the body of the shroud segment 20 about the insert 32.

Figure 4A:
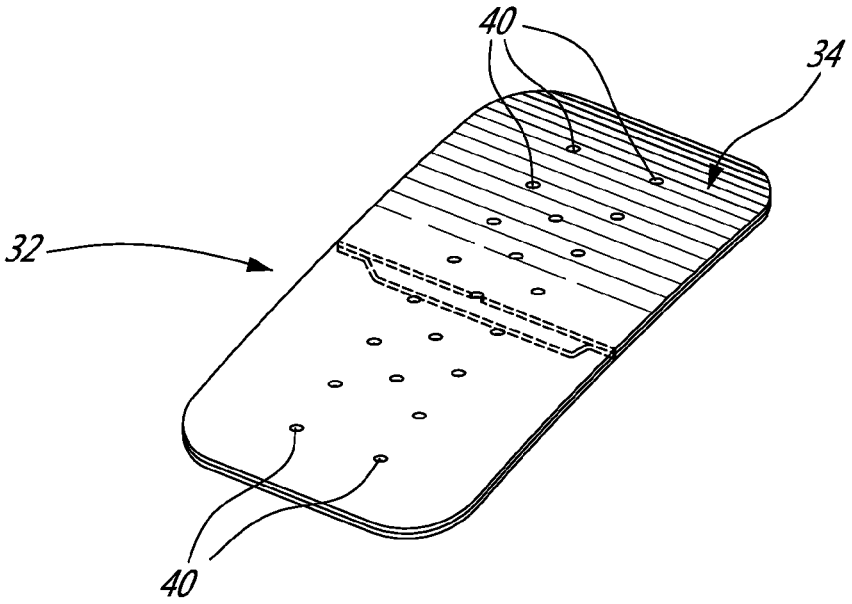
FIGS. 4*a* and 4*b* are top and bottom views of the insert.
Figure 4B:
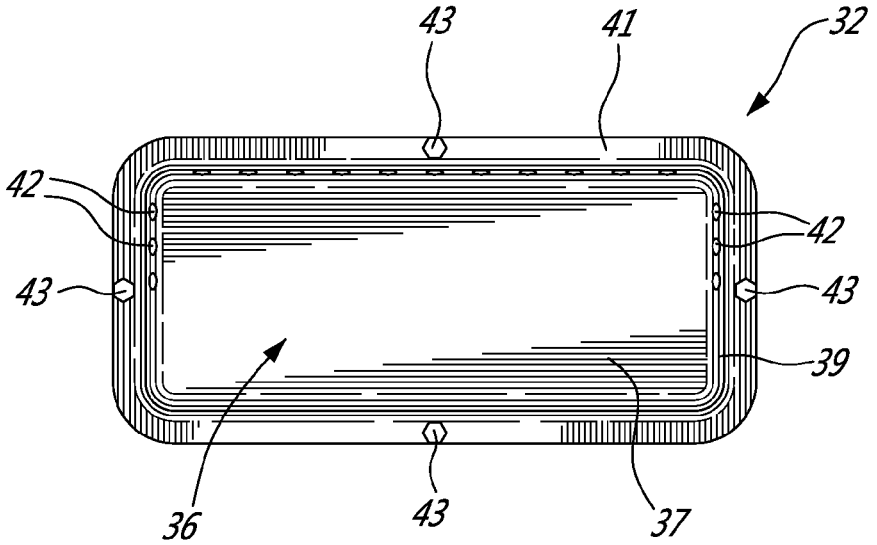

As shown in FIGS. 3, 4*a* and 4*b*, the insert 32 may comprise an impingement plate 34 secured over a vessel member 36 so as to define a cooling air cavity 38 therebetween. The impingement plate 34 forms part of the radially outer surface 26 of the platform 28 and is exposed for receiving cooling air. The vessel member 36 may be provided in the form of a low profile pan-like container having a generally rectangular flat bottom wall 37, sidewalls 39 projecting upwardly from the perimeter of the bottom wall 37 and a peripheral rim 41 projecting outwardly from the upper end of the sidewalls 39. The vessel member 36 bounds the cooling air cavity 38 which would otherwise have to be directly machined into the platform 28 of the shroud segment 20. The impingement plate 34 rests on the peripheral rim 41 and may be attached thereto such as by spot welding or the like (see for instance spot welding locations 43 in FIGS. 4*a* and 4*b*). The impingement plates 34 defines a plurality of impingement holes 40 for directing cooling air into the cavity 38 to provide impingement cooling for the platform 28 of the shroud segment 20. Cooling holes 42 may also be defined in the sidewalls 39 of the vessel member 36. Both the impingement plate 34 and the vessel member 36 may be made from sheet metal. The holes 40 and 42 may be drilled or otherwise formed in the sheet metal members.

According to one example, the impingement plate 34 is cut from a first piece of sheet metal. The vessel member 36 is cut from a second piece of sheet metal which is then bent into the desired pan-like container shape. The so separately formed impingement plate 34 and vessel member 36 are then joined together to form a hollow insert, as shown in FIGS. 4*a* and 4*b*. The impingement plate 34 and the vessel member 36 may be made from a wide variety of metals. For instance they could be made from Nickel or Cobalt Alloys. The insert material is selected to withstand the pressures and temperatures inside the mold during the MIM process as well as the sintering temperatures. Material properties (e.g.: Young Modulus) are other aspects to be considered to provide more or less flexibility of the entire component that could impact turbine blade tip clearance (i.e. the gap between the gas path side surface of the shroud and the tip of the turbine blades). The holes 40 and 42 may be drilled before or after welding the impingement plate 34 to the peripheral rim 41 of the vessel member 36.

Figure 5A:
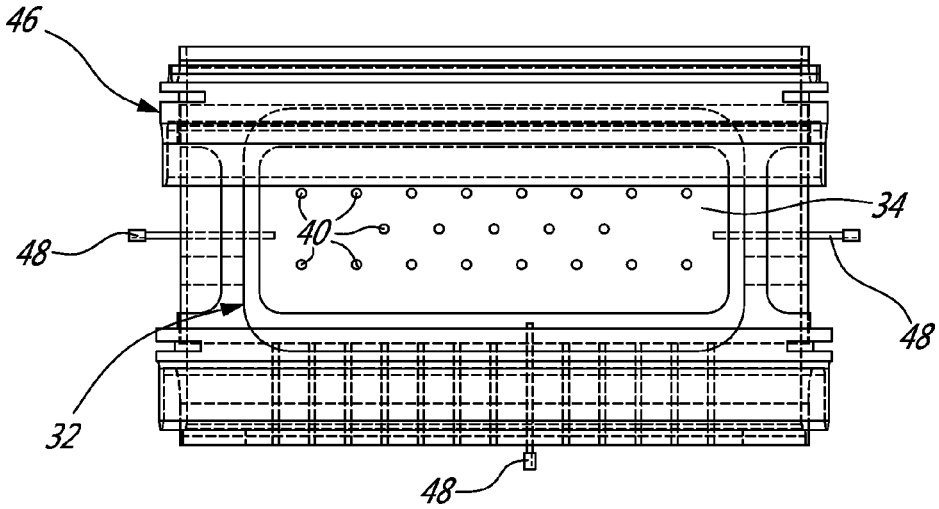
FIGS. 5*a* and 5*b* are top and cross-section views illustrating the positioning of the insert in an injection mold.
Figure 5B:
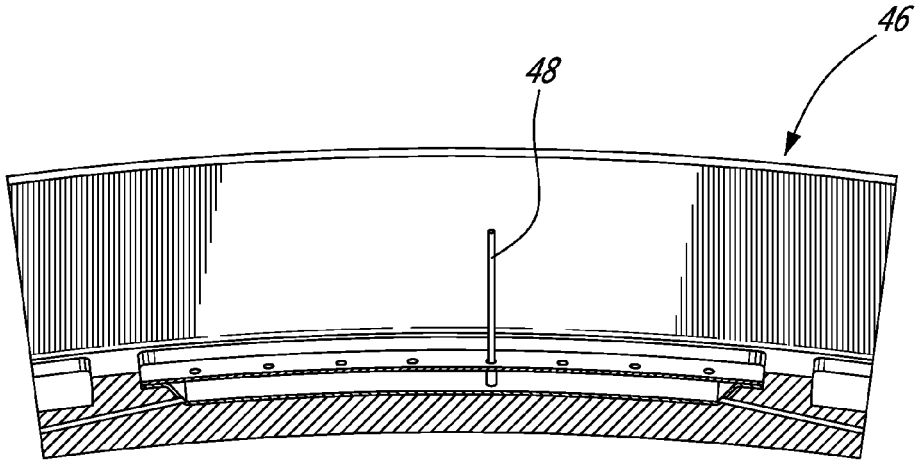

The so formed insert 32 is then positioned in an injection mold 46 including top and bottom mold details 46*a* and 46*b* (FIGS. 6 and 7) complementary defining a cavity having a shape corresponding to the shape of the turbine shroud segment 20. As shown in FIGS. 5*a* and 5*b*, pins 48 or the like can be engaged in the holes 42 to hold the insert 32 in position in the mold 46. In addition of providing support to the insert 32, the pins 48 plug the holes 42 and thus prevent ingestion of MIM feedstock into the cooling air cavity 38 during the injection process. The space occupied by the pins 48 will also form corresponding air passages 50 (FIGS. 2 and 3) into the MIM shroud segment body, which air passages 50 are aligned and in fluid flow communication with the holes 42 in the insert 32, thereby allowing cooling air to flow out from the cavity through holes 42 and passages 50. The impingement holes 40 in the impingement plate 34 are sealed off from the MIM feedstock by the top detail 46*a* of the mold 46.

Figure 6:
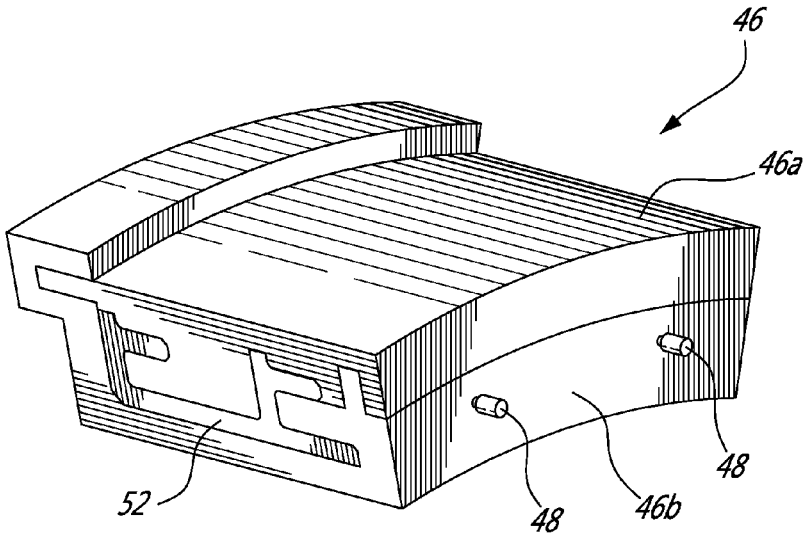
FIG. 6 is a schematic view illustrating a base metal powder mixture injected into the injection mold to form a metal injection molded (MIM) shroud segment about the insert.

Once the insert 32 has been properly positioned in the mold 46, a MIM feedstock comprising a mixture of metal powder and a binder is injected into the mold 46 to fill the mold cavity about the insert 32, as schematically shown in FIG. 6. The MIM feedstock may be a mixture of Nickel or Cobalt alloy (e.g.: IN625) powder and a low melting material (e.g.: wax) binder. It is understood that the metal powder can be selected from among a wide variety of metal powder. The binder can also be selected from among a wide variety of binders, including, but not limited to waxes, polyolefins such as polyethylenes and polypropylenes, polystyrenes, polyvinyl chloride etc. It is understood that the maximum operating temperature to which the shroud segment will be exposed influence the choice of metal powder. The choice of material for the insert is also partly dictated by the maximum operating temperature. As mentioned above, the MIM heat treatment temperatures will also influence the insert material selection. The melting temperature of the insert material must be greater than the injection temperature. It is also recommended that the insert material be metallurgically compatible with the MIM material to ensure minimum bonding strength and minimize chance of delamination in production or in service.

The MIM feedstock is injected at a low temperature (e.g. at temperatures equal or inferior to 250 degrees Fahrenheit (121 deg. Celsius)) and at low pressure (e.g. at pressures equal or inferior to 100 psi (689 kPa)). Metal injections molding at low temperatures and pressures allows the use of thinner sheet metal and a wider variety of materials to form the insert. If the temperatures or the pressures were to be too high, the integrity of the sheet metal insert could be compromised and, thus, a stronger and potentially heavier insert would have to be used.

Figure 7:
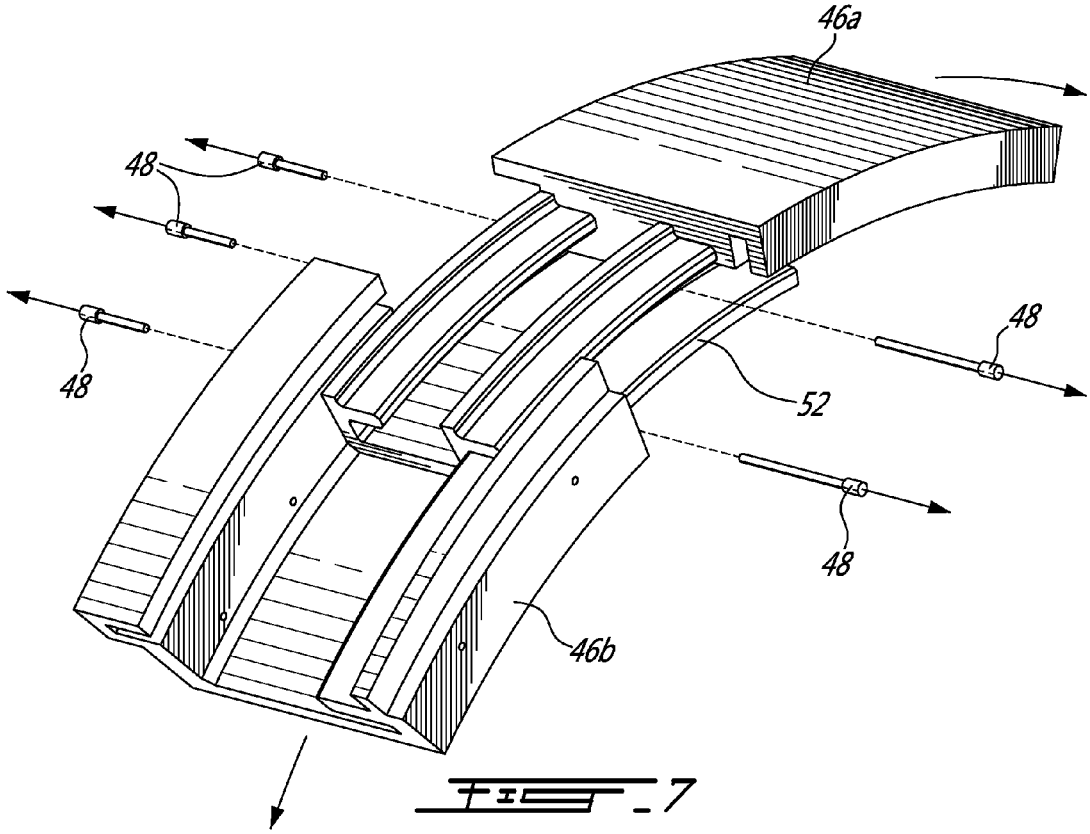
FIG. 7 is a schematic view illustrating how the mold details are disassembled to liberate the shroud segment with the integrated/imbedded impingement plate.

The resulting "green" shroud segment body with the integrated or imbedded insert 32 is cooled down and de-molded from the mold 46, as shown in FIG. 7. The removal of the pins 48 leaves corresponding air channels or passages 50 in the green shroud segment body. The term "green" is used herein to refer to the state of a formed body made of sinterable powder or particulate material that has not yet been heat treated to the sintered state.

Next, the green shroud segment body is debinded using solvent, thermal furnaces, catalytic process, a combination of these know methods or any other suitable methods. The resulting debinded part (commonly referred to as the "brown" part) is then sintered in a sintering furnace. The sintering temperature of the various metal powders is well-known in the art and can be determined by an artisan familiar with the powder metallurgy concept. It is understood that the sintering temperature is lower than the melting temperature of the metal used for the insert.

Next, the resulting sintered shroud segment body may be subjected to any appropriate metal conditioning or finishing treatments, such as grinding and/or coating.

The above described shroud manufacturing method eliminates the needs for costly machining operations normally required to form the cooling air cavity in the cold outer side of the shroud platform. According to the above example, the cooling air cavity is formed by imbedding a sheet metal vessel member 36 in the platform 28. The present manufacturing method also eliminates the need for welding a separate impingement plate to the segment body over the cooling air cavity. The impingement plate is rather integrated to the shroud segment body at the time of molding. Other time consuming machining operations typically required to form the air channels or passages communicating with the cooling air cavity are no longer required. The above shroud manufacturing method may provide for 25 to 50% cost reduction.

The manufacturing process may be generally summarized as follows. The components of the insert 32, namely the impingement plate 34 and the vessel member 36, are first individually formed. As mentioned hereinabove, the impingement plate and vessel member may be both formed from sheet metal. Then, as shown in FIGS. 4*a* and 4*b*, the impingement plate 34 and the vessel member 36 may be spot welded or otherwise suitable joined together to form a unitary hollow insert structure. The impingement and cooling holes 40 and 42 in the impingement plate 34 and the vessel plate 36 may be drilled or otherwise formed before or after assembling the plates together. As shown in FIGS. 5*a* and 5*b*, the insert 32 is then positioned in the injection mold 46 using pins 48 or other suitable holding devices. The pins 48 holding the insert 32 may also be used to form passages or channels 50 in the body of the shroud segment while at the same time blocking ingestion of metal powder mixture into the insert cavity 38 via holes 42 during the injection process. The base metal powder mixture or MIM feedstock is injected into the mold 46 to form a "green compact" with an integrated sheet metal insert as shown in FIG. 6. After the consolidation of the base metal powder mixture into a green compact, the mold details are disassembled to liberate the green shroud segment 52 (see FIG. 7). Then, the MIM process continues with the usual debinding and sintering heat cycle treatments to remove low melting binding material which forms part of the metal powder mixture and to consolidate the metal powder and obtain the desired mechanical properties. Once, the MIM process has been completed, the composite shroud segment with integrated impingement plate and cooling air cavity may be coated and/or subjected to a final grinding step or other conventional finishing operations.

The above description is meant to be exemplary only, and one skilled in the art will recognize that changes may be made to the embodiments described without departing from the scope of the invention disclosed. For example, the insert could be made from a single piece of material. The shape and configuration of the insert can also vary depending on the design of the shroud segment. The combination of materials used to form the insert and the shroud segment could also vary. Still other modifications which fall within the scope of the present invention will be apparent to those skilled in the art, in light of a review of this disclosure, and such modifications are intended to fall within the appended claims.

The invention claimed is:

1. A method of manufacturing a shroud segment for a gas turbine engine, the method comprising: providing an insert defining a cooling air cavity covered by an impingement plate having a plurality of holes defined therethrough; holding the insert in position in an injection mold; and metal injection molding (MIM) a shroud segment body about the insert to form a composite component, including injecting a metal powder mixture into the injection mold to partially imbed the insert into the shroud segment body and subjecting the composite component to debinding and sintering operations.

2. The method of claim 1, wherein the impingement plate is provided in the form of a first sheet metal member, and wherein providing an insert comprises welding the first sheet metal member over a second sheet metal member.

3. The method defined in claim 2, wherein the second sheet metal member is formed into a vessel member having a peripheral rim, and wherein welding comprises welding the first sheet metal member to said peripheral rim.

4. The method defined in claim 3, wherein said first sheet metal member is spot welded to said peripheral rim of the vessel member.

5. The method defined in claim 1, comprising blocking the holes defined in the insert to prevent the metal powder mixture from flowing into the cooling air cavity during the metal injection process.

6. The method of claim 1, wherein the turbine shroud segment is metal injection molded with cooling air passages in flow communication with the cooling air cavity of the insert.

7. The method of claim 6, wherein additional holes are defined in the insert, and wherein pins are engaged in said holes to hold the insert in position in the injection mold, and wherein said pins are used to form said cooling air passages in the MIM shroud segment body.

8. The method of claim 7, wherein the insert comprises a vessel member on top of which is secured the impingement plate, the additional holes being defined in the vessel member, and wherein the pins block the metal injection mixture from entering into the cooling air cavity of the insert via the additional holes during the injection process.

9. A method of creating a cooling air cavity in a shroud segment of a gas turbine engine, the method comprising: metal injection molding (MIM) a shroud segment body about a hollow insert having a cavity covered by an impingement plate, the impingement plate being provided at a radially outwardly facing surface of the MIM shroud segment body and having a plurality of holes defined therethrough for admitting air into the cavity of the hollow insert.

10. The method of claim 9, wherein metal injection molding the shroud segment body about the hollow insert comprises holding the hollow insert inside an injection mold in a position in which the impingement plate will form part of the radially outwardly facing surface.

11. The method of claim 9, wherein metal injection molding comprises placing the hollow insert at a predetermined position within a mold and filling the mold with a metal powder mixture.

12. The method of claim 9, comprising forming the hollow insert by welding a first sheet metal member over a second sheet metal member, the cavity of the hollow insert being defined between said first and second sheet metal members, and defining holes in said first sheet metal member to form said impingement plate.

13. A shroud segment of a gas turbine engine comprising a metal injection molded (MIM) shroud body, an insert at least partly imbedded on a radially outer side of the MIM shroud body, the insert comprising first and second members defining therebetween a cooling air cavity, said first member having a plurality of impingement holes defined therethrough for directing cooling air into said cooling air cavity.

14. The shroud segment defined in claim 13, wherein the first member is a sheet metal impingement plate, and wherein the second member is a sheet metal pan-like container, the sheet metal impingement plate covering the sheet metal pan-like container.

15. The shroud segment defined in claim 14, wherein the sheet metal pan-like container has a flat bottom and a low peripheral rim, the sheet metal impingement plate resting on and being secured to said low peripheral rim.

16. The shroud segment defined in claim 13, wherein the MIM shroud body has forward and aft hooks projecting from the radially outer side of the body, and wherein said insert is disposed between said forward and aft hooks.

17. The shroud segment defined in claim 14, wherein holes are defined in the sheet metal pan-like container, said holes being in fluid flow communication with air channels defined in the MIM shroud body.

* * * * *